US007926404B2

(12) United States Patent
Brittingham

(10) Patent No.: US 7,926,404 B2
(45) Date of Patent: Apr. 19, 2011

(54) GAS REGULATOR FLASH HIDER

(75) Inventor: Kevin Tyson Brittingham, Norcross, GA (US)

(73) Assignee: Advanced Armament Corp., Lawrenceville, GA (US)

( * ) Notice: Subject to any disclaimer, the term of this patent is extended or adjusted under 35 U.S.C. 154(b) by 360 days.

(21) Appl. No.: 11/998,540

(22) Filed: Dec. 1, 2007

(65) Prior Publication Data

US 2010/0275769 A1 Nov. 4, 2010

(51) Int. Cl.
*F41A 21/34* (2006.01)

(52) U.S. Cl. ..... 89/14.2

(58) Field of Classification Search ..... 89/14.2, 89/193, 14.3, 192
See application file for complete search history.

(56) References Cited

U.S. PATENT DOCUMENTS 785,974 A * 3/1905 McClean ..... 89/193
1,413,903 A * 4/1922 Czegka ..... 89/14.1
2,058,897 A * 10/1936 Marek ..... 89/193
2,748,662 A * 6/1956 Simpson ..... 89/193
2,791,944 A * 5/1957 Harvey ..... 89/193
2,883,781 A * 4/1959 Harvey ..... 42/105
2,895,383 A * 7/1959 Reed ..... 89/193
2,941,450 A * 6/1960 Ray et al. ..... 89/191.01
3,020,807 A * 2/1962 Hailston et al. ..... 89/193
3,051,057 A * 8/1962 Ivy ..... 89/193
3,968,727 A * 7/1976 Hyytinen ..... 89/191.02
4,433,611 A * 2/1984 Baumann ..... 89/193
4,599,934 A * 7/1986 Palmer ..... 89/193
4,702,146 A * 10/1987 Ikeda et al. ..... 89/193
5,596,161 A 1/1997 Sommers
5,631,438 A * 5/1997 Martel ..... 89/14.3
6,837,139 B2 1/2005 Meyers

* cited by examiner

*Primary Examiner* — Bret Hayes
*Assistant Examiner* — Reginald Tillman, Jr.
(74) *Attorney, Agent, or Firm* — Wood, Herron & Evans, LLP

(57) ABSTRACT

A gas regulator which incorporates a flash hider for use with gas operated firearms. By incorporating a flash hider around the gas vent for the host firearms operating system, unburnt particles which produce flash from this exit point may be effectively disrupted. By disrupting and redirecting these unburnt powder particles flash is thereby eliminated from the firearms operating system. In the preferred embodiment, an open-pronged flash hider is used, but the device is not limited to this specific design. Military end users are particularly interested in an article of manufacture which eliminates flash from the gas system since it will disrupt the use of night vision and give away a soldier's position during low light or no light operations.

3 Claims, 2 Drawing Sheets

GAS REGULATOR FLASH HIDER

CROSS-REFERENCED TO RELATED APPLICATIONS

This application claims the benefit of a PPA filed on May 25, 2007 as delivered by the United States Postal Service #EB409094289US by the present inventor.

BACKGROUND OF THE INVENTION

1. Field of Invention

This invention generally relates to firearm flash reduction devices, specifically to devices which may be placed on the vent of a gas operated rifle for the purpose of suppressing the flash which results from the combusting powder being vented from the rifles gas operating system when the host firearm is discharged.

2. Prior Art

Various systems exist for reducing the muzzle flash of a firearm when it has been discharged. Previous designs provide a combination of features which culminated in a system for reducing the muzzle flash of a firearm to various degrees. BE Meyers four tine design and the Smith Enterprises Vortex flash suppressor are two popular designs currently available. The proposed apparatus is a new use for the Blackout flash hider which is another design of mine.

Gas operating systems for firearms which utilize a piston often vent gases from the operating system. When these gases exit the confines of the firearms operating system combustion of the un-burnt powder particles takes place and creates a flash. For military and police users flash creates several hazards. These hazards include, but are not limited to giving away the users position and eliminating his night vision capability when the rifle is discharged.

The proposed apparatus incorporates a flash hider onto the gas plug or over the gas vent of a gas operated rifle. With a flash hider disrupting the combustion of un-burnt powder particles the bright flash typically associated with the discharge of a rifle will be eliminated or greatly reduced.

OBJECTS AND ADVANTAGES

Accordingly several objects and advantages of the present invention are (a) To provide an apparatus that will reduce the flash signature of gas operated firearms.

(b) To provide a device which will reduce the flash resulting from the gas system of a gas operated firearm.

(c) To provide a unique system for eliminating the flash signature of a gas operated rifle while being used in conjunction with a traditional muzzle mounted flash suppressor.

(d) To provide an article of manufacture which will reduce flash enough to allow for the proper employment of night vision equipment with the host firearm Still further objects and advantages will become apparent from a consideration of the ensuing description and drawings.

SUMMARY

My device encompasses a flash hider being incorporated into the gas system of a semi automatic rifle. Rifles which uses a gas piston operating system, well known in the prior art, has a vent, or port located near the front of the rifle where excess gas from the firearms operating system is vented or expelled. When these excess gasses are expelled the previously unburnt powder particles are super heated then suddenly exposed to an oxygen rich environment. Upon exposure to oxygen the powder particles are ignited resulting in flash. Flash hiders have long been incorporated onto the barrel of a firearm to eliminate this phenomenon at muzzle. Since the total elimination of a firearms flash signature is the goal of modern militaries I decided to incorporate a flash hider which would interface with the gas regulator switch of a military rifle, specifically the FN SCAR-L and SCAR-H family of weapons.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
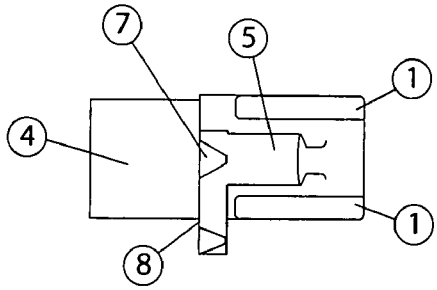
FIG. 1 shows a top external view of the preferred embodiment gas regulator flash hider.
Figure 2:
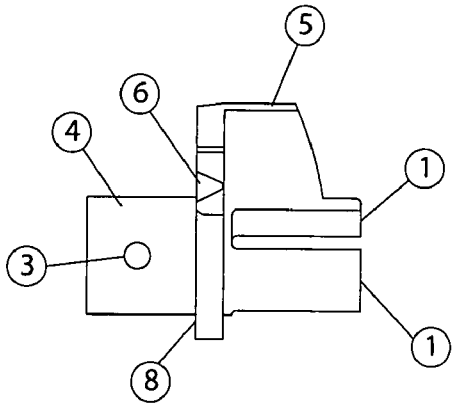
FIG. 2 shows a horizontal side view of the preferred embodiment gas regulator flash hider.
Figure 3:
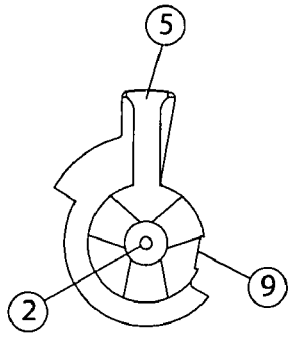
FIG. 3 shows a front view of the preferred embodiment gas regulator flash hider.

The gas regulator flash hider is manufactured using a lathe and mill to complete both circular and plunge cuts which are necessary for its construction. A metallic alloy is used as material As used herein, the word "front" or "forward" corresponds to the forward area of the gas regulator flash hider (i.e., to the right as shown in FIGS. 1, 2 and 3); "rear" or "rearward" or "back" corresponds to the direction opposite the forward area of the gas regulator flash hider (i.e., to the left as shown in FIGS. 1, 2 and 3); "longitudinal" means the direction along or parallel to the longitudinal axis a of the gas regulator flash hider; and "transverse" means a direction perpendicular to the longitudinal direction.

GLOSSARY OF TERMS

1: Flash hider tines
2: Gas exit aperture
3: Gas port
4: Gas regulator bearing surface
5: Gas regulator housing
6: Second position
7: First position
8: Mating shoulder
9: Retention Divot.
10: Firearm
11: Noise Suppressor
12: Gas block
13: Gas regulator mounting point In FIGS. 1 & 2, there are illustrated a top, horizontal view of the gas regulator flash hider. Flash hider tines 1 are added to the front of the gas regulator housing 5. A gas exit aperture 2 vents excess gases from the firearm operating system. Gas regulator bearing surface 4 is inserted into the firearm operating system and gas port 3 provides a vent for gas to pass through the firearm operating system through the gas exit aperture 2. The gas regulator housing 5 can be manipulated into two positions. Second position 6 typically allows little or no gas to flow through the operating system. Second position 6 is designed to minimize the back pressure that the firearm operating system is exposed to when being fired with a noise suppressor in place. Noise suppressors are well known in the prior art. First position 7 allows a flow of gas which is optimized to work with the rifle when no noise suppressor is in place.

FIG. 3 shows a front view of the gas regulator housing 5. Located on the right side of this device is a means for securing the gas regulator housing 5 termed the retention divot 9. This retention divot 9 prevents the gas regulator housing 5 from being forced out of the host firearm 10 when it is discharged.

Figure 4:
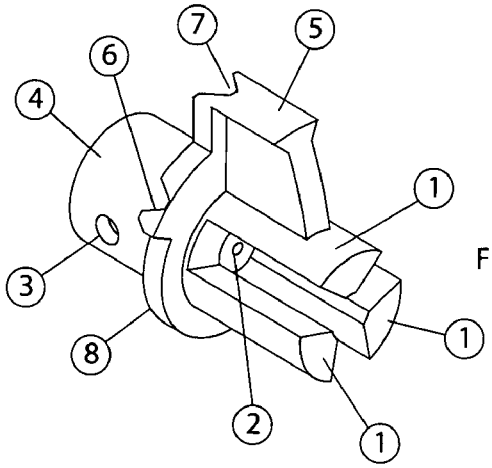
FIG. 4 shows a canted horizontal side view of the preferred embodiment gas regulator flash hider.

FIG. 4 shows a 3D horizontal side view of the preferred embodiment gas regulator flash hider housing 5. Most prominently displayed are the flash hider tines 1 and their orientation about the gas exit aperture 2.

Figure 5:
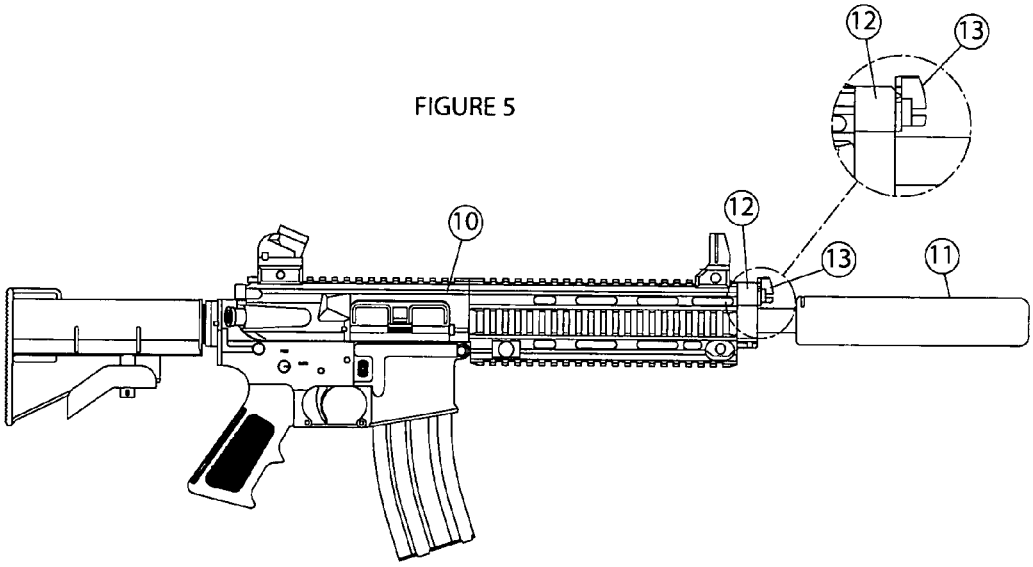
FIG. 5 shows a horizontal view of a gas operated rifle and a close up of the gas block and gas regulator mounting point.

FIG. 5 shows a side view of a rifle with the proposed gas regulator flash hider housing 5 installed. As illustrated the proposed device does not interfere with the installation of a noise suppressor 11. The gas regulator housing 5 will secure to the gas regulator mounting position 13 which is an integral part of the gas block 12. The location of the gas regulator housing 5 was selected to allow for easy adaptation of the new device onto existing firearms designs. The flash hider aspect of the proposed apparatus is simply implemented onto the existing gas regulator.

When firearm 10 is discharged the expanding gases flow through the gas block 12 and are forced through the gas port 3 when the gas regulator housing 5 is in second position 6. Subsequently the gas exits the host firearm 10 through the gas exit aperture 2. The geometry of flash hider tines 1 are designed to prevent a flash from occurring by disrupting the ignition of unburned powder particles as they come into contact with an oxygen rich environment. Flash suppressors are well known in the prior art but I intend to use the design being claimed as novel in RPA filed Apr. 16, 2007.

The preferred embodiment gas regulator flash hider has two positions. First position 7 is used when the firearm 10 is being fired without a noise suppressor 11. Second position 6 restricts the amount of gas being forced into the firearm 10 operating system by restricting the size of the gas port 3. This position prevents too much gas from entering the firearm 10 operating system. Sizing the hole appropriately varies from weapon to weapon and is outside of the scope of my present invention. In either position excess gas is vented through the gas exit aperture 2 thereby forcing the expanding gases through a small hole causing the unburnt propellant to ignite. The flash hider tines 1 prevent this ignition by slowing and dispersing the high velocity powder particles. My unique design is meant to eliminate flash from the gas block 12 of gas operated firearm 10.

When the gas regulator housing 5 is inserted into the gas system of a firearm there is a mating surface 8 which is designed to interface with the host weapons gas system. The preferred embodiment of the proposed apparatus is designed to interface with the FN Manufacturing SCAR-L and SCAR-H rifles, but a design for the HK 416 rifle is underway.

CONCLUSION, RAMIFICATIONS, AND SCOPE

Accordingly the reader will see that, by the invention, I have provided an apparatus which is designed to effectively eliminate flash being produced as a result of a firearm venting excess gas from its operating system. The proposed apparatus is particularly suited to being used in conjunction with a noise suppressor which dramatically increases back pressure. I have also afforded any user of my invention the ability to use night vision devises while firing a weapon with my gas regulator flash hider in place. Further is can be seen that the user of the proposed apparatus being used in conjunction with a flash suppressor, or noise suppressor will produce little or no flash signature when the firearm is discharged.

While my above drawings and description contain many specificities, these should not be construed as limitations on the scope of the invention, but rather as an exemplification of one preferred embodiment thereof. For example the Gas regulator flash hider may be adopted to work with other gas operating systems which vent excess gas from the operating system.

Accordingly, the scope of the invention should be determined not by the embodiments illustrated, but by the appended claims and their legal equivalents.

The invention claimed is:

1. A gas-operated firearm having an operating system and a barrel with a muzzle, the firearm comprising;

a duct through which expanding gas is diverted from the barrel to cycle the operating system of the firearm;

said duct having a gas exit aperture other than the muzzle through which excess operating gas is vented to outside the firearm; and said gas exit aperture including an external flash hider structure configured to disperse unburned propellant particles in the vented gas, thereby reducing visible flash at said gas exit aperture, wherein said flash hider structure includes a plurality of tines extending outwardly from said gas exit aperture and defining elongated lateral slots between the tines for the dispersion of the vented gas.

2. A gas-operated firearm having a barrel and an operating system, the firearm comprising;

a gas block in fluid communication with the barrel and configured to receive gas diverted from the barrel to cycle the operating system of the firearm; and a gas regulator flash hider including a housing engaged with said gas block and defining a valve movable between first and second positions, the first position selected to direct gas into said gas block when a noise suppressor is not used on the firearm, and the second position selected to restrict the flow of gas into said gas block when a noise suppressor is used on the firearm;

said gas regulator flash hider having a gas exit aperture other than the muzzle through which excess operating gas is vented to outside the firearm; and said gas exit aperture including an external flash hider structure configured to disperse unburned propellant particles in the vented gas, thereby reducing visible flash at said gas exit aperture, wherein said flash hider structure includes a plurality of tines extending forwardly from said gas exit aperture and defining elongated lateral slots between the tines for the dispersion of the vented gas.

3. A gas regulator flash hider for a gas-operated firearm having a barrel and an operating system, the gas regulator flash hider comprising:

a housing defining a flow-regulating valve moveable between first and second positions, the first position directing gas from the firearm barrel into the operating system to cycle the operating system when a noise suppressor is not used on the firearm, and the second position restricting the flow of gas from the firearm barrel into the operating system when a noise suppressor is used on the firearm;

a gas exit aperture other than the muzzle through which excess operating gas is vented to outside the firearm; and said gas exit aperture including an external flash hider structure configured to disperse unburned propellant particles in the vented gas, thereby reducing visible flash at said gas exit aperture, wherein said flash hider structure includes a plurality of tines extending forwardly from said gas exit aperture and defining elongated lateral slots between the tines for the dispersion of the vented gas.

* * * * *